US005320496A

United States Patent [19]

Manini et al.

[11] Patent Number: 5,320,496

[45] Date of Patent: Jun. 14, 1994

[54] HIGH-CAPACITY GETTER PUMP

[75] Inventors: Paolo Manini; Bruno Ferrario, both of Milan, Italy

[73] Assignee: SAES Getters SpA, Milan, Italy

[21] Appl. No.: 59,375

[22] Filed: May 11, 1993

[30] Foreign Application Priority Data

Jul. 17, 1992 [IT] Italy ..... MI92 A 001752

[51] Int. Cl.[5] ..... F04B 37/02

[52] U.S. Cl. ..... 417/51

[58] Field of Search ..... 417/48, 49, 51

[56] References Cited

U.S. PATENT DOCUMENTS

| | | | |
|---|---|---|---|
| 3,203,901 | 8/1965 | Della Porta . | |
| 3,284,253 | 6/1971 | Wintzer . | |
| 3,305,290 | 2/1967 | Ganssen . | |
| 3,428,168 | 2/1969 | Reash | 417/51 X |
| 3,457,448 | 7/1969 | Scott | 417/48 X |
| 3,584,253 | 6/1971 | Wintzer . | |
| 3,609,064 | 9/1971 | Giorgi . | |
| 3,662,522 | 5/1972 | Della Porta et al. . | |
| 3,780,501 | 12/1973 | Della Porta et al. . | |
| 3,926,832 | 12/1975 | Barosi . | |
| 3,961,897 | 6/1976 | Giorgi et al. . | |
| 4,071,335 | 1/1978 | Barosi . | |
| 4,137,012 | 1/1979 | Della Porta et al. . | |
| 4,254,280 | 4/1981 | Hellier | 417/51 |
| 4,269,624 | 5/1981 | Figini . | |
| 4,306,887 | 12/1981 | Barosi et al. . | |
| 4,312,669 | 1/1982 | Boffito et al. . | |
| 4,907,948 | 3/1990 | Barosi et al. . | |

FOREIGN PATENT DOCUMENTS 2077487 12/1981 United Kingdom .

*Primary Examiner*—Richard E. Gluck

*Attorney, Agent, or Firm*—David R. Murphy

[57] ABSTRACT

An improved high-capacity getter pump, comprising a plurality of porous sintered piled-up annuli made from a non-evaporable getter material and having: i) a first planar surface having a central hole; ii) a second planar surface, having a broader central hole, parallel to said first surface and spaced therefrom by a distance "d" of 1–10.5 mm; iii) a third intermediate planar surface, interposed between said first and second surfaces, spaced from said first surface by a thickness "t" of 0.5–5.0 mm and having a hole coincident with the hole of said first surface; wherein the first surface of a subsequent annulus is in contact with the second surface of a preceding annulus and wherein the first surface of a subsequent annulus is spaced from the third surface of a preceding annulus by a gas conductance having a height "c" of 0.5–10 mm.

15 Claims, 2 Drawing Sheets

HIGH-CAPACITY GETTER PUMP

The present invention relates to an improved high-capacity getter pump, suitable for creating and maintaining the vacuum, for instance in an ultra-high vacuum chamber or in a high-energy particle accelerator.

Getter pumps are well known in the art and are suitable for creating and maintaining vacuum. The first commercially successful getter pump, described in U.S. Pat No. 3,780,501, was employing, in a housing, a pleated metal strip having a getter metal embedded therein. Additional examples of such getter pumps were described in U.S. Pat. Nos. 3,609,064; 3,662,522; 3,961,897 and 4,137,012. Although these former getter pumps enjoyed a wide commercial success and market acceptance, they were still suffering from a drawback, residing in a limited sorption capacity inside a given volume.

In order to increase said sorption capacity, it was suggested to simply fill the pump housing with a getter material in the form of compressed pellets, having size and shape similar to the tablets used in the field of drugs; such pellets were typically showing a cylindrical shape, with a diameter of 5–10 mm and a height of 2–10 mm. However, when the housing is filled with such pellets, the access of the gas to the bulky getter structure is far from being satisfactory. Another drawback, bound to the use of said pellets, was their tendency to produce undesired loose particles; moreover the bulky structure can show safety problems because of the possibility of a high exothermicity of the getter material, during possible ignitions, and this is true in particular when the used getter material has a low activation temperature.

Accordingly, it is a first object of the present invention to provide an improved getter pump substantially free from one or more of the drawbacks hereinabove.

Another object of the invention is to provide an improved getter pump having a higher sorption rate per unit volume, with respect to the getter pumps of the prior art.

A further object of the invention is to provide an improved getter pump having a higher sorption capacity per unit volume, with respect to the getter pumps of the prior art.

An additional object of the invention is to provide an improved getter pump resorting neither to pleated coated strips nor to pellets of getter material.

Other objects of the invention. will be apparent to those of ordinary skill in the art, by reference to the following disclosure and drawings.

In its broadest aspect, the invention relates to an improved high-capacity getter pump, suitable for creating and maintaining the vacuum, for instance in a high-energy particle accelerator and in an ultra-high vacuum chamber, said pump comprising a plurality of porous sintered piled up annuli (flat disks) made from a non-evaporable getter material and having:

i) a first planar surface having a central hole;

ii) a second planar surface (having a broader central hole, with respect to said first surface) essentially parallel to said first surface and spaced therefrom by a distance "d" of about 1–10.5 mm (preferably 2–10 mm);

iii) a third intermediate planar surface, essentially parallel to said first and second surfaces, interposed between said first and second surfaces, spaced from said first surface by a thickness "t" of essentially 0.5–5.0 mm and having a hole essentially coincident with the hole of said first surface;

wherein the first surface of a subsequent annulus is in contact with the second surface of a preceding annulus; wherein the first surface of a subsequent annulus is spaced from the third (intermediate) surface of a preceding annulus by a gas conductance (empty intermediate space), having a height "c" of 0.5–10 mm (preferably 1–5 mm) and wherein the values of "t", "d" and "c" are interrelated by the following equation:

$$d=t+c$$

Said gas conductances allow the gas molecules to enter the porous getter structure at a fast rate and the higher porosity of the porous sintered annuli better promotes the efficiency of the gas sorption (with respect to the pleated strips and to the pellets or tablets of the prior art).

Said annuli are suitably piled up in a housing, defining an inner channel with the edge of their holes. The getter pump according to the invention is furthermore equipped with a heater, for heating the annuli at the activation temperature and also at the desired operative temperature, and with a flange fastening said housing to a vacuum.

The porous sintered annuli of the pump according to the invention may have a shape selected from circular, elliptical, polygonal and combinations thereof (optionally tapered and/or bevelled). Moreover said annuli have a density from 1 to 5 g/cm$^3$ and preferably from 1.5 to 3.5 g/cm$^3$ and a surface area from 0.05 to 1 m$^2$/g (preferably 0.1–1 m$^2$/g).

The getter pump according to the present invention may be employed for maintaining the vacuum in a wide range of vacuum devices and apparatuses, for instance closed vacuum vessels (like e.g. a dewar or a vacuum jacket for a fluid transfer piping), particle accelerators (like for instance a synchrotron) and ultra-high vacuum chambers. The new getter pumps can maintain a vacuum level as high as $10^{-6}$ and even $10^{-12}$ mbar ($10^{-10}$ Pa).

A wide range of non-evaporable getter metals may be employed for the manufacture of the pumps according to the invention, for instance zirconium, titanium, hafnium, tantalum, thorium, uranium, niobium, mixtures thereof and alloys of these metals with each other and with other metals, such alloys being or being not intermetallic compounds. These getter metals may be used alone or in admixture with other materials, like for instance antisintering agents. An exemplifying but not limiting series of non-evaporable getter metals for the manufacture of said porous sintered blades comprises:

a) an alloy containing 84% Zr, balance Al, as described e.g. in U.S. Pat. No. 3,203,901;

b) a metal composition according to U.S. Pat. No. 3,584,253, based on Zr, Ta, Hf, Nb, Ti or U.

c) a metal composition according to example 3 of U.S. Pat. No. 3,926,8321, based on a combination of Zr with a Zr—Al alloy;

d) the intermetallic compound $Zr_2Ni$ described e.g. in U.S. Pat. No. 4,071,335;

e) the Zr—M1—M2 alloys according to U.S. Pat. No. 4,269,624, where M1 is V or Nb and M2 is Fe or Ni;

f) the Zr—Fe alloys according to U.S. Pat. No. 4,306,887;

g) certain alloys of zirconium, vanadium and iron, as described in U.S. Pat. No. 4,312,669, as well as other alloys of zirconium and vanadium and minor amounts of transition metals such as manganese;

h) certain alloys of zirconium, titanium and iron, as described in U.S. Pat. No. 4,907,948.

According to a preferred embodiment of the present invention, said non-evaporable getter metal is selected from the Zr—V—Fe alloys and the Zr—Ti—Fe alloys, optionally in combination with Zr alone and/or Ti alone, these last being optionally in the form of hydrides. The combinations disclosed in GB Patent Application 2,077,487, in the name of the Applicant have proved to be particularly advantageous, being obtained from:

I) a ternary particulate Zr—V—Fe non-evaporable getter alloy having a composition (by weight) lying, when plotted on a ternary diagram, within a polygon having as its corners the following points (% b.w.):

a) 75% Zr-20% V-5% Fe b) 45% Zr-20% V-35% Fe c) 45% Zr-50% V-5% Fe

II) a particulate non-evaporable getter metal, selected from Zr and Ti, wherein the Zr and/or Ti particles have a smaller average size than the alloy particles.

Such combinations are traded by the applicant as

One advantageous method for manufacturing the porous sintered annuli of the pump according to the invention, starting from the combinations hereinabove, comprises the following steps:

A) said non-evaporable getter metal is prepared in the form of a loose powder of Zr—V—Fe and/or Zr—Ti—Fe alloy particles, optionally in admixture with particles of Zr alone and/or Ti alone and with an expansion agent;

B) said loose powder (or the consequent mixture) is poured in a mould and sintered at a temperature essentially comprised between 700° and 1200° C. under an inert atmosphere (for instance argon).

Said sintering temperature of 700°-1200° C., maintained for a time comprised between a few minutes and a few hours, is generally considered as a satisfactory one, whereas a lower temperature requires a longer time; the sintering time should give rise to a dimensional stability.

Said alloy particles have preferably a pre-sintering surface area equal to or higher than 0.15 and preferably 0.25 $m^2/g$ and a pre-sintering particle size up to 400 μm, preferably from 1 to 128 μm and even better from 1 to 50 μm. Said Zr and/or Ti particles, in their turn, have preferably an average particle size from 1 to 55 micrometer and a surface area from 0.1 to 1.0 $m^2/g$, wherein the weight ratio between the alloy particles and said Zr and/or Ti particles is suitably from 10:1 to 1:1.

The expansion agent may suitably be an inorganic and/or organic base containing nitrogen and/or phosphorus, which completely decomposes below the sintering temperature, for instance urea, azo-di-carbonamide and/or a carbamate like ammonium carbamate, in amounts from 0.1 to 15% b.w., with respect to the non-evaporable getter material (preferably 2-10%). The formula of azo-di-carbonamide is:

$$NH_2—CO—N=N—CO—NH_2$$

The heater may be arranged inside or outside the housing of the getter pump. The heating may be carried out by conduction or by radiation, for instance by means of a UHV quartz lamp.

The following drawings (FIG. 1-3) are supplied for illustrative purposes but do not limit in any way the scope of the invention; in particular:

Figure 1:
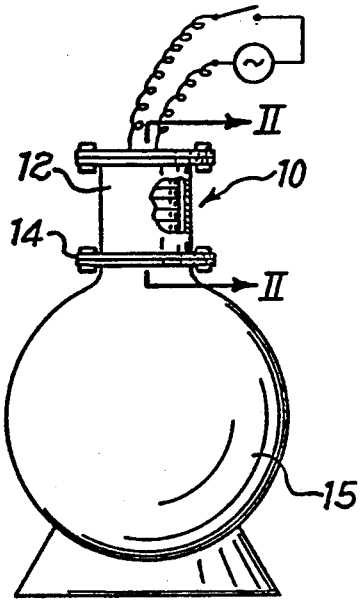
FIG. 1 is a schematic representation of a getter pump according to the present invention in operating conditions.
Figure 3:
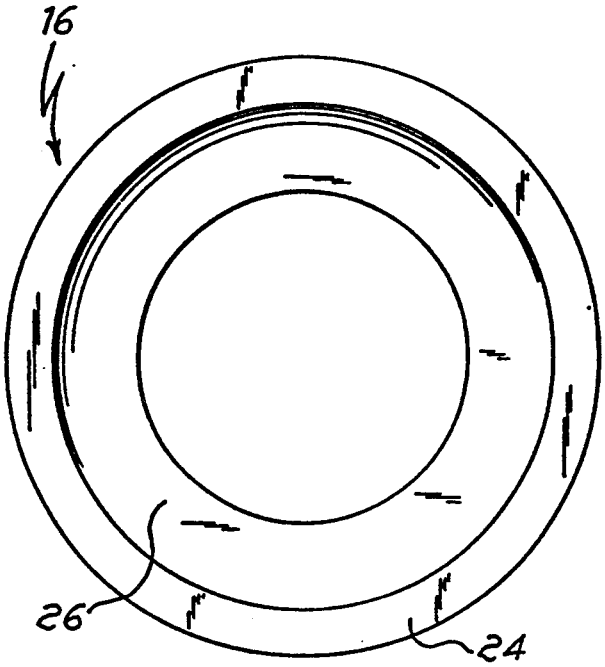
FIG. 3 is a view of an annulus of a getter pump according to the present invention.
Figure 2:
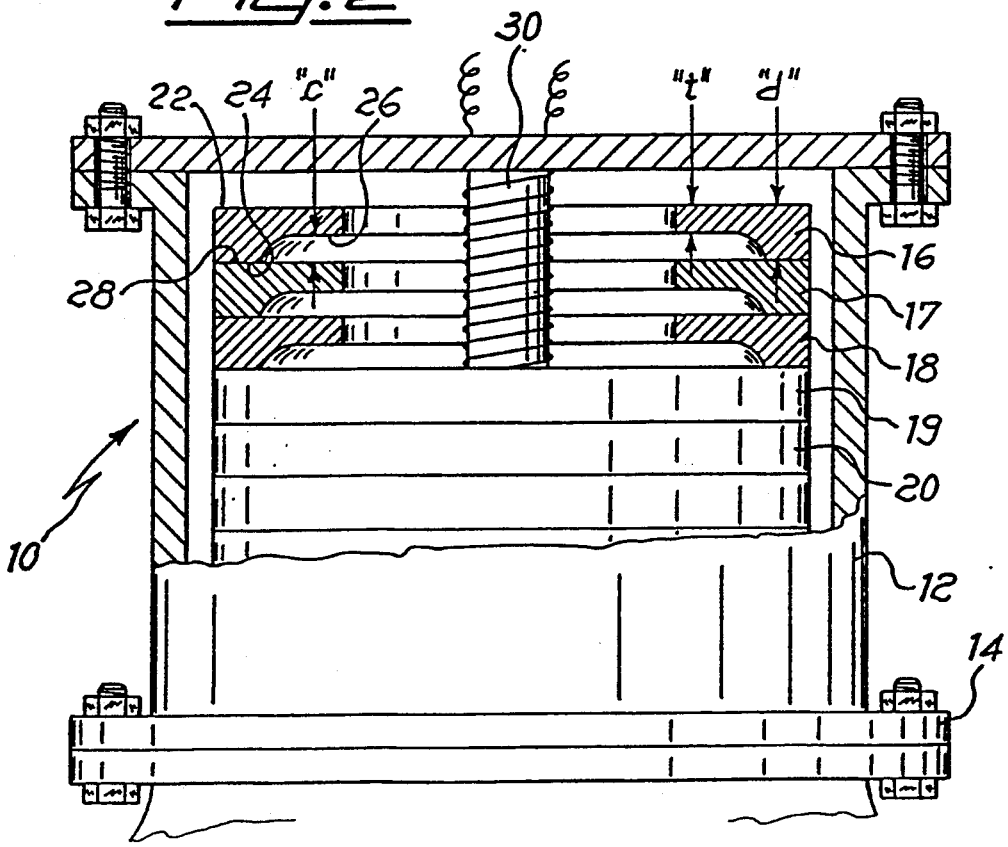
FIG. 2 is an enlarged section view of a getter pump according to the present invention, taken along line II—II of FIG. 1.
Figure 4:
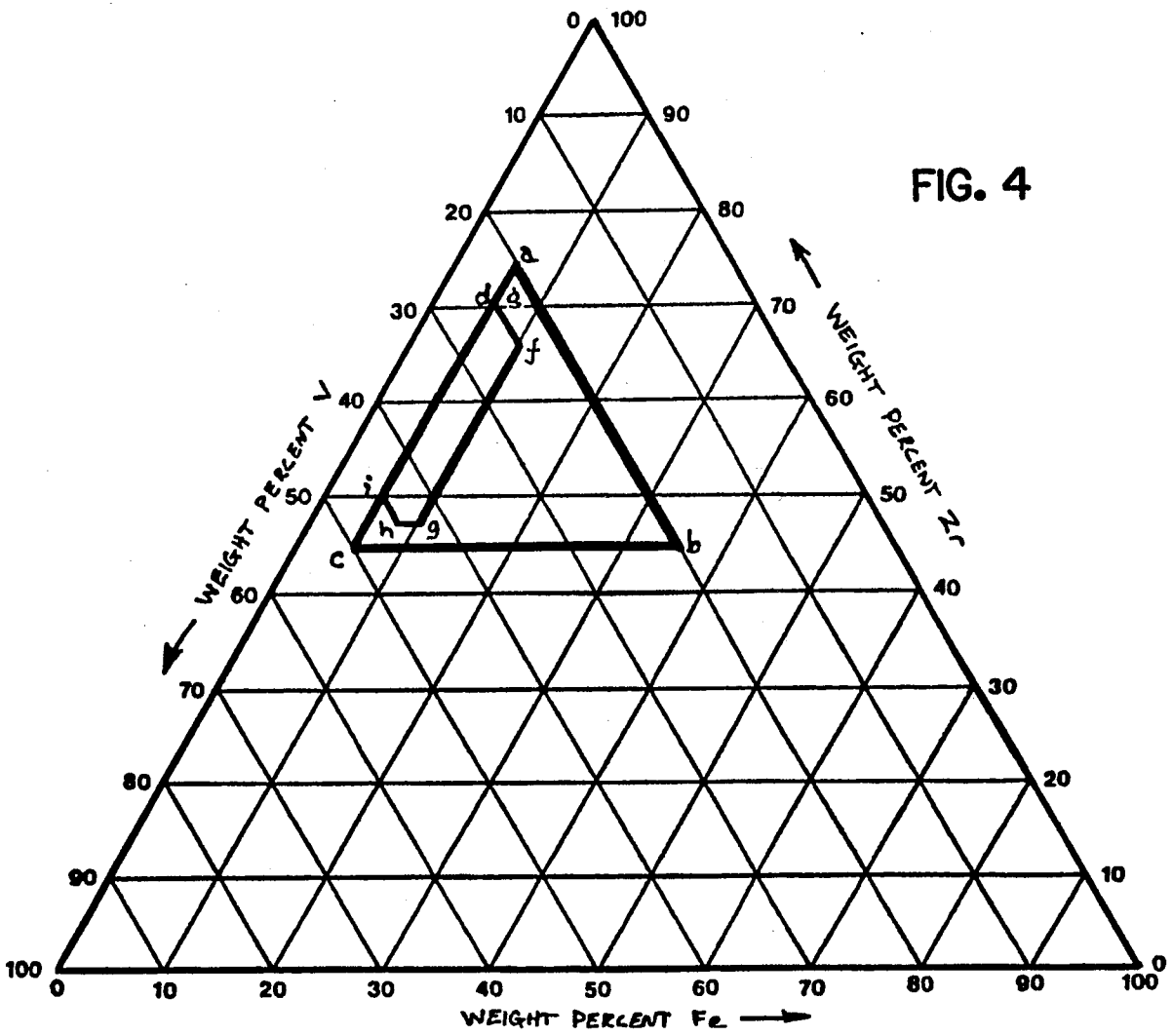
FIG. 4 is a ternary diagram showing a composition of gettering alloys useful in the present invention.

Referring now to the drawings in general and in particular FIGS. 1 and 2, there is shown an improved non-evaporable getter pump 10, having a gas-tight cylindrical housing 12 provided with a flange 14, which constitutes. means for fastening said housing 12 to a vacuum vessel 15.

The getter pump 10 of FIG. 2 has a plurality of porous sintered annuli 16, 17, 18, 19, 20 piled up in said cylindrical housing 12, consisting of a non-evaporable getter metal. Each annulus has a first planar surface 22 and a second planar surface 24, essentially parallel to said first surface 22, spaced from the first surface by a distance "d" of about 1-10.5 mm.

Each annulus is furthermore showing an intermediate planar surface 26, essentially parallel to said first planar surface 22, interposed between first planar surface 26 and second planar surface 24.

Annuli 16, 17, 18, 19, 20 are piled up in the cylindrical housing 12, namely they are each other superimposed; the empty space (gas conductance) between the intermediate planar surface 26 of a preceding annulus and the first planar surface 28 of a subsequent annulus constitutes a gas conductance and the height of said conductance is from 0.5 to 10 mm (preferably 1-5 mm).

Getter pump 10 is equipped also with a thermocouple, not shown in the drawings, and with a coaxial inner heater 30, which provides for the heating of annuli 17, 18, 19, 20, at the activation temperature (of the getter material) and also at the operative temperature.

The getter pumps according to the present invention have a sorption capacity several times greater, in a given volume, than the getter pumps of the prior art. Although the invention has been described in considerable detail with reference to certain preferred embodiments, it will be understood that many changes and modifications can be carried out without departing from the scope of the invention.

We claim:

1. An improved high-capacity getter pump, suitable for creating and maintaining vacuum, comprising a plurality of porous sintered piled-up annuli made from a non-evaporable getter material and having:

i) a first planar surface having a central hole;

ii) a second planar surface having a broader central hole, with respect to said first surface, said second planar surface being essentially parallel to said first planar surface spaced therefrom by a distance "d" of about 1 to 10.5 mm;

iii) a third intermediate planar surface, essentially parallel to said first and second surfaces, interposed between said first and second surfaces, spaced from said first planar surface by a thickness "t" of essentially 0.5 to 5.0 mm and having a hole essentially coincident with the hole of said first planar surface;

wherein the first planar surface of a subsequent annulus is in contact with the second planar surface of a preceding annulus;

wherein the first surface of a subsequent annulus is spaced from the third intermediate planar surface of a preceding annulus by a gas conductance having a height "c" of 0.5 to 10 mm; and wherein the values of "t", "d" and "c" are interrelated by the equation:

$$d=t+c.$$

2. The pump of claim 1, wherein said annuli are piled-up in a housing, defining an inner channel with the edge of their holes.

3. The pump of claim 1, equipped with a heater, for heating the annuli at the activation temperature and also at the desired operative temperature, and with a flange for fastening said housing to a vacuum vessel.

4. The pump of claim 1, wherein the porous sintered annuli have a shape selected from circular, elliptical, and polygonal and have a density from 1 to 5 g/cm$^3$ and a surface area from 0.05 to one m$^2$/g.

5. The pump of claim 4 wherein said non-evaporable getter material is selected from the group of metals consisting of zirconium, titanium, hafnium, tantalum, thorium, uranium, niobium, mixtures thereof and alloys of these metals with each other and with other metals, these metals being used alone or in admixture with other materials.

6. The pump of claim 5, wherein said non-evaporable getter material is selected from the Zr—V—Fe alloys and the Zr—Ti—Fe alloys.

7. The pump of claim 6, wherein said non-evaporable getter material is a combination of:

I) a ternary particulate Zr—V—Fe non-evaporable getter alloy having a composition (by weight) lying, when plotted on a ternary diagram, within a polygon having as its corners the following points (% b.w.):

a) 75% Zr-20% V-5% Fe b) 45% Zr-20% V-35% Fe c) 45% Zr-50% V-5% Fe

II) a particulate non-evaporable getter metal, selected from Zr and Ti, wherein the Zr and/or Ti particles have a smaller average size than the alloy particles.

8. The pump of claim 1 wherein the second planar surface is spaced from the first planar surface by a distance "d" of about 1 to 10 mm.

9. The pump of claim 1 wherein the first surface of a subsequent annulus is spaced from the planar surface of a preceding annulus by a gas conductance having a height "c" of one to 5 mm.

10. The pump of claim 1 wherein the porous sintered annuli have a density from 1.5 to 3.5 g/cm$^3$ and a surface area from 0.1 to one m$^2$/g.

11. The pump of claim 5 wherein the alloys are intermetallic compounds.

12. The pump of claim 5 wherein the alloys are used in admixture with other materials.

13. The pump of claim 12 wherein the other materials are antisintering agents.

14. The pump of claim 5 wherein said non-evaporable getter material is selected from the Zr—V—Fe alloys and the Zr—Ti—Fe alloys in combination with a member selected from the group consisting of Zr alone and Ti alone.

15. The pump of claim 5 wherein said non-evaporable getter material is selected from the Zr—V—Fe alloys and the Zr—Ti—Fe alloys in combination with a member selected from the group consisting of Zr hydride and Ti hydride.

* * * * *